US005735256A

United States Patent [19]

Monk

[11] Patent Number: 5,735,256

[45] Date of Patent: Apr. 7, 1998

[54] BALL LAUNCHING DEVICE

[76] Inventor: Randolph F. Monk, 216 N. Washington St., Galion, Ohio 44833

[21] Appl. No.: 753,510

[22] Filed: Nov. 26, 1996

[51] Int. Cl.[6] ..... F41B 11/00

[52] U.S. Cl. ..... 124/65; 124/81

[58] Field of Search ..... 124/72, 63, 64, 124/65, 81, 83, 84, 85

[56] References Cited

U.S. PATENT DOCUMENTS

| | | | |
|---|---|---|---|
| 1,171,197 | 2/1916 | Harmon . | |
| 2,505,428 | 4/1950 | Pope . | |
| 2,574,408 | 11/1951 | Moe | 124/85 X |
| 2,601,555 | 6/1952 | Pope | 124/65 |
| 2,630,108 | 3/1953 | White | 124/65 |
| 2,725,868 | 12/1955 | Foster | 124/64 X |
| 2,725,869 | 12/1955 | Barber | 124/35 X |
| 2,935,980 | 5/1960 | Garver | 124/81 X |
| 2,975,779 | 3/1961 | Pope . | |
| 3,477,419 | 11/1969 | Caetano | 124/37 X |
| 3,584,614 | 6/1971 | Harvath . | |
| 3,765,396 | 10/1973 | Kienholz et al. | 124/65 |
| 3,915,143 | 10/1975 | Waller . | |
| 4,006,726 | 2/1977 | Sweeton et al. | 124/81 |
| 4,014,307 | 3/1977 | Horvath | 124/81 |
| 4,091,791 | 5/1978 | Castelli et al. . | |
| 4,241,717 | 12/1980 | Mariani . | |
| 4,335,701 | 6/1982 | Bozich . | |
| 4,892,081 | 1/1990 | Moormann . | |
| 5,058,561 | 10/1991 | Starr . | |
| 5,113,842 | 5/1992 | Moormann . | |
| 5,115,794 | 5/1992 | Moormann . | |
| 5,267,549 | 12/1993 | Webber . | |
| 5,377,655 | 1/1995 | Arad . | |
| 5,377,656 | 1/1995 | Lewinski et al. . | |
| 5,429,108 | 7/1995 | Hseih . | |

*Primary Examiner*—John A. Ricci
*Assistant Examiner*—Thomas A. Beach
*Attorney, Agent, or Firm*—George C. Atwell

[57] ABSTRACT

A portable ball launching device is disclosed which includes a support stand positionable on a ground surface and an elongated launching tube mounted to the support stand in a generally horizontal disposition and from which projectiles are ejected. The launching tube has an ingress end and an opposite egress end, and disposed within and concentric with the launching tube is a slidable, linearly reciprocable rod. The rod has an inner end to which a piston is secured for movement concomitant with the rod, and the piston compresses air within the tube in order to forcibly eject projectiles from the egress end. The ball launching device also includes a plurality of interchangeable shooting heads with each shooting head selectively removably securable to the egress end of the tube and each shooting head includes a strip secured to an inner annular gasket which causes deflection of the projectiles as the projectiles are ejected from the launching tube.

9 Claims, 5 Drawing Sheets

BALL LAUNCHING DEVICE

BACKGROUND OF THE INVENTION

The present invention relates to toy guns, and more particularly pertains to a toy gun for propelling projectiles in a non-linear flight path.

Toy guns are a favorite toy for children, and have been so for many decades. Among the variety of toy guns available are cap guns, water guns, sound-producing guns, dart guns, pneumatic and spring-loaded guns that shoot an assortment of projectiles, paint ball guns, and laser tag guns. The designs of toy guns range from models that can fit within the palm of a small child's hand to models that are mounted on stands and support legs. In addition, toy guns are available which come with battery-charged backpacks for producing sound and light effects.

The prior art discloses a wide variety of toy guns ranging from simple hand-held, air-powered tubes to complex electronically-activated devices. Among the prior art, the general concept of hurling projectiles is disclosed by U.S. Pat. No. 2,975,779 (Pope) wherein a ball-containing pneumatic pressure cylinder ejects a projectile when a batter steps on a bulb forcing air through a pressure hose and to the cylinder; U.S. Pat. No. 3,584,614 (Horvath) which discloses a pneumatic ball-throwing device which ejects a plurality of balls, in succession, upwardly out of a hopper; U.S. Pat. No. 3,915,143 (Waller) which discloses a wheeled baseball-propelling machine including a bank of indicator lights which indicate ready, set, and fire positions; U.S. Pat. No. 4,091,791 (Castelli et al.) which discloses a ball-throwing machine in which balls are received into a firing chamber and are then ejected through a tubular barrel having an off-center opening for giving the ball spin; and U.S. Pat. No. 4,241,717 (Mariani) which discloses a tennis ball-projecting machine having a pair of pivotable casings which are adjustable to alter the trajectory of tennis balls ejected therefrom.

The prior art also discloses a number of projectile launching guns wherein the projectile is physically struck by elements for causing the ejection of the projectiles. U.S. Pat. No. 1,171,197 (Harmon) discloses a toy gun which employs a plunger to physically strike a pellet or projectile. U.S. Pat. No. 2,505,428 (Pope) discloses an air gun device which uses a rod and spring assembly to eject projectiles. U.S. Pat. No. 4,335,701 (Bozich) discloses a ball-projecting apparatus which employs a spring-biased plunger to physically eject hollow balls from a guide chute portion.

U.S. Pat. No. 5,267,549 (Webber) and U.S. Pat. No. 5,377,655 (Arad) disclose projectile launching toy guns with multiple barrels which hold projectiles and from which projectiles are launched.

Toy guns which eject spherical projectiles and other material as well as non-spherical projectiles include U.S. Pat. No. 5,058,561 (Starr) which ejects cylinders in the form of beer cans; U.S. Pat. No. 5,377,656 (Lewinski et al.) which ejects both soft foam balls and water; and U.S. Pat. No. 5,429,108 (Hsieh) which ejects a finned tubular projectile from a blow tube.

U.S. Pat. Nos. 4,892,081; 5,113,842; and 5,115,794 (Moormann) disclose compressible ball launchers in which a plunger compresses air to force projectiles through a constriction and out the barrel of the ball launcher.

However, despite the assortment and variety of projectile launching devices, there remains a need for a ball launching device that accurately shoots projectiles at a target or a practicing batter and has the ability to simulate a variety of pitches by using interchangeable shooting heads.

SUMMARY OF THE INVENTION

The present invention comprehends a ball launching device for shooting a plurality of projectiles in succession at a target or at a practicing batter in order to simulate baseball practice hitting.

The ball launching device includes a portable, lightweight support stand which is easily positionable and repositionable on a ground surface. The support stand includes vertical legs which can telescope to alter the trajectory of ejected projectiles. Stabilizing elements in the form of elastic cords attached to the support stand can be extended so that stakes at the ends of the cords can be inserted into the ground for further stabilizing the support stand on the ground surface.

The ball launching device includes a launching tube which is normally horizontally disposed and mounted upon the support stand, and from which the projectiles, preferably soft closed cell foam balls, are ejected. The launching tube includes an ingress end where air enters the tube and the user stands, and an opposite egress end into which the projectiles are loaded and then ejected therefrom.

Disposed within the launching tube and attachable to the launching tube are structural elements for ejecting projectiles from the egress end and also for altering the path of travel of the projectiles as they leave the egress end. The launching tube includes an elongated rod disposed therein for linear slidable reciprocable movement to eject projectiles. The rod has an inner end completely enclosed within the launching tube and an outer end which projects past the ingress end and which terminates at a handle which is gripped by the user. Mounted to the inner end of the rod is a piston which moves concomitant with the rod within the launching tube. The piston has an outside diameter slightly less than the inside diameter of the launching tube so that the rod can slide unimpeded within the launching tube. In order to limit the forward movement of the piston toward the egress end, a piston abutment member is disposed within the launching tube adjacent the egress end of the launching tube. The piston abutment member can extend transverse across the diameter of the tube or it can be attached to the inside of the tube and, can comprise, for example, a metal block or washer mounted on a transversely-extending stud or bolt. The use of such structure creates a stop within the launching tube for halting further forward movement of the piston. In order to provide added momentum to the ejected projectiles, a spring is disposed within the egress end of the tube. When projectiles are loaded into the egress end, they compress the spring against the piston abutment member so that the projectiles are loaded against the spring.

A plurality of interchangeable heads are used to alter the path of travel of the projectiles as they are ejected from the egress end of the tube. The interchangeable heads are each selectively removably securable to the egress end of the tube, and each head includes an aperture extending therethrough, an inwardly-disposed gasket circumjacent the aperture, and a projectile flight deflection means in the form of a semi-circular strip secured to the gasket and conforming to the curvature of the gasket. As the projectiles are ejected from the egress end by a brief and forceful compression of air from the movement of the piston toward the egress end, the projectiles are squeezed through the aperture which has a smaller inside diameter than the outside diameter of the projectiles and are compressed against the semi-circular strip. In addition, as the projectiles are momentarily compressed, the semi-circular strip provides less friction resistance for the ball than the gasket. This alters the velocity and flight path of the projectiles, and imparts a spin to the projectiles, as they are ejected from the launching tube and out through the interchangeable heads. The radial positioning of the semi-circular strip of each head with respect to the axis of the tube determines the kind and amount of deflection or deviation of the projectiles from a flight path coincident with the axis of the tube.

It is an objective of the present invention to provide a lightweight, portable, easy-to-operate ball launching device which can be used for recreation and baseball practice hitting.

Another objective of the present invention is to provide a ball launching device which includes a plurality of interchangeable shooting heads, each of which causes projectiles to deflect away from a straight flight path when ejected from the launching tube.

A better understanding of the invention will become more apparent from the description taken in conjunction with the accompanying drawings.

DETAILED DESCRIPTION OF THE PREFERRED EMBODIMENT

Figure 1:
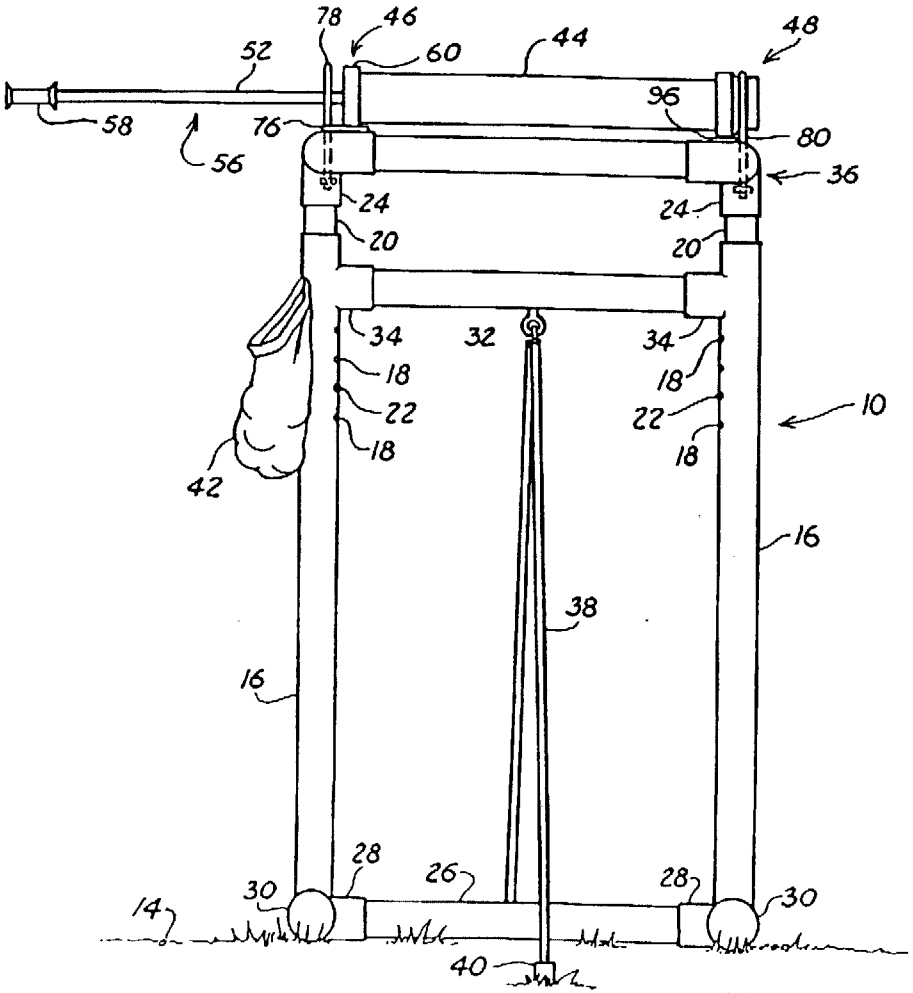
FIG. 1 is a side elevational view of the ball launching device of the present invention.

Illustrated in FIGS. 1–24 is a ball launching device 10 for selectively ejecting or expelling projectiles toward, for example, a target, a practicing batter positioned some distance away, or an individual positioned to receive and catch the launched projectiles. Although a number of different types of projectiles can be launched from the device 10, the preferred type of projectile is a closed-cell soft foam ball 12 as shown in FIGS. 5 and 20–23. The device 10 is lightweight, and the main structural components are preferably manufactured from hard plastic so that the device 10 can be easily positioned on a ground surface 14, such as shown in FIG. 1, or picked up and transported to a garage or basement for storage. The device 10 is preferably manufactured from conduit pipe (straight pieces, elbows, T's, etc.) with the various pieces selected, sized, and cut so that the device 10 is easy to assembly and disassemble.

Figure 4:
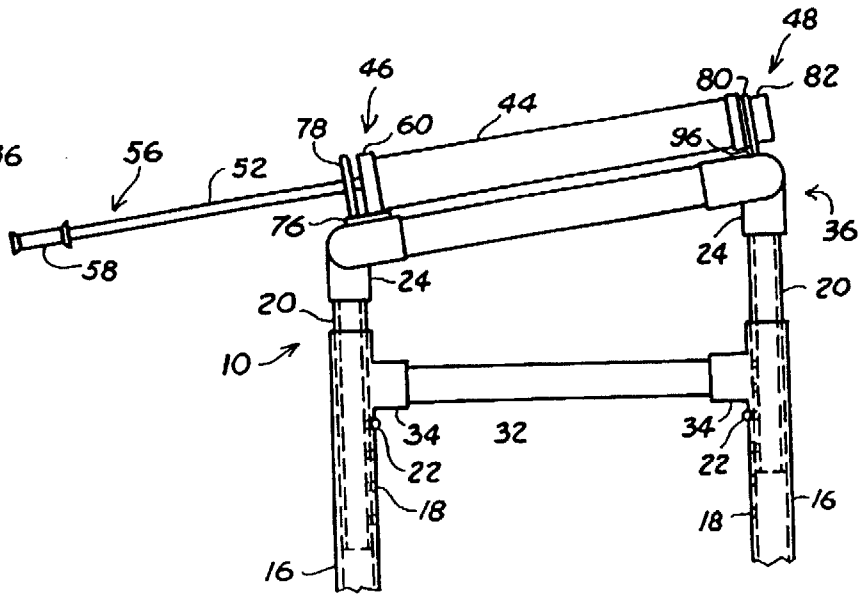
FIG. 4 is a side elevational view of the ball launching device first shown in FIG. 1, illustrating the extension of the front adjustable leg.
Figure 3:
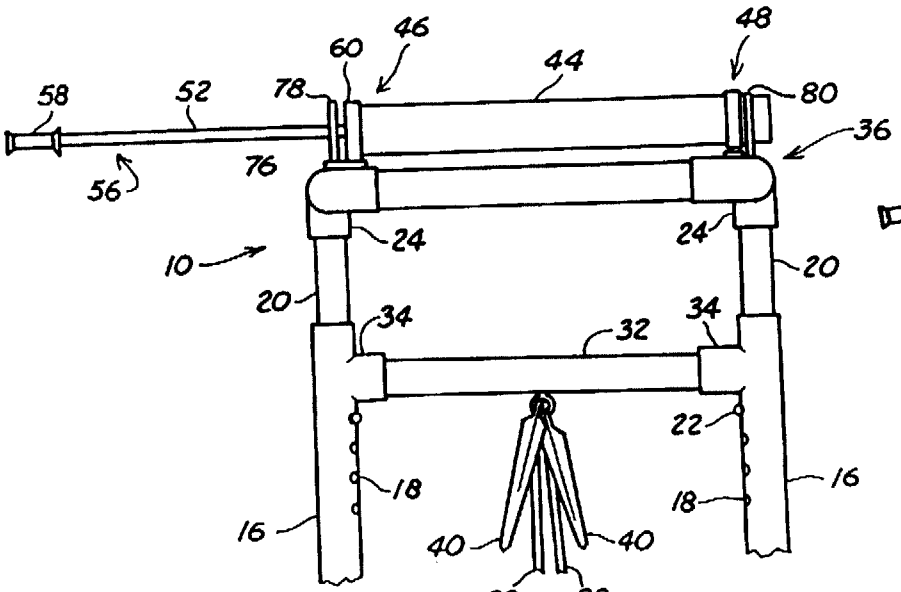
FIG. 3 is a side elevational view of the ball launching device first shown in FIG. 1, illustrating the extension of the adjustable legs.

As shown in FIGS. 1–4, the device 10 includes a support means for spacing the structural elements which launch the balls 12 from the ground surface 14. The support means includes a pair of spaced-apart, non-adjustable, vertically-extending legs 16 each of which includes an integral telescoping means. The legs 16 are selectively adjustable by the telescoping means so that the trajectory of the ball 12 can be altered as it is ejected from the device 10. The telescoping means includes a plurality of spaced-apart detent ball holes 18 located on the upper end of each leg 16. A shorter adjustable leg 20 is received within each respective leg 16 for selective slidable movement therein and each leg 20 includes a detent ball 22 secured thereon. Each ball 22 can be received within the respective holes 18 during the slidable upward or downward movement of the legs 20 during the process of adjusting the trajectory of the device 10. Both legs 20 can be adjusted to the same height or, as shown in FIG. 4, one leg 20 can be selectively adjusted while the other leg 20 remains substantially received within the respective leg 16. Each leg 20 includes a T-shaped member 24 removably securable thereto and projecting upwardly therefrom, and each member 24 can be integral with the leg 20 or a separate structural piece adapted for removable attachment thereto.

Figure 2:
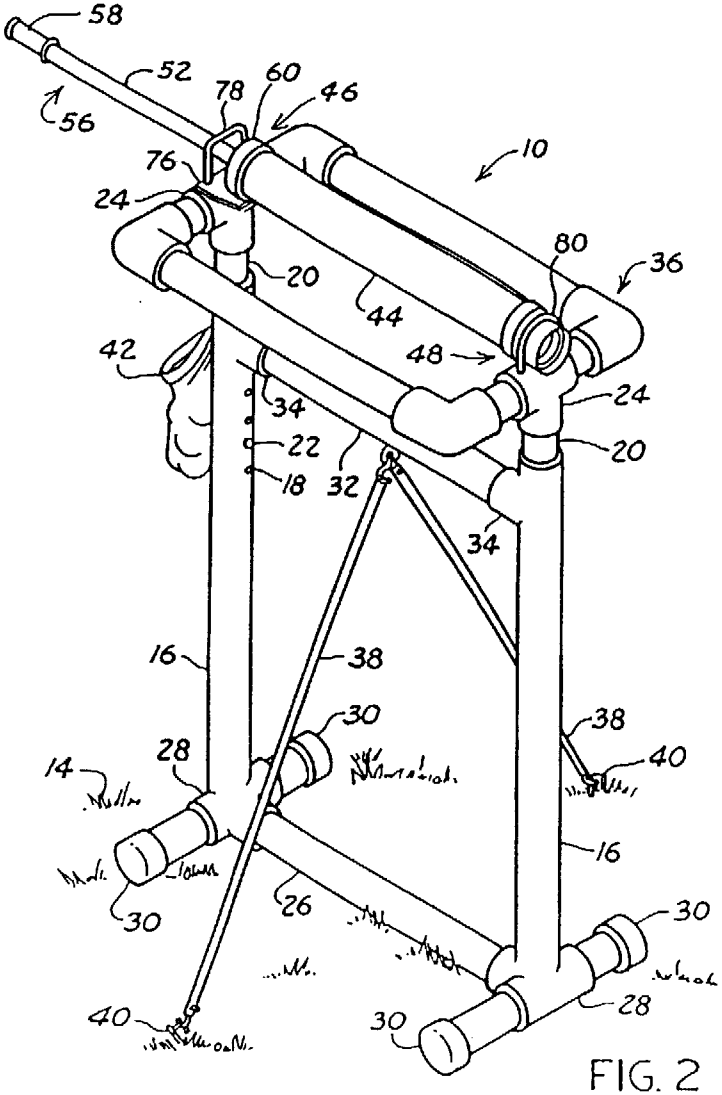
FIG. 2 is a perspective view of the ball launching device first shown in FIG. 1.

As shown in FIGS. 1 and 2, the device 10 includes a horizontal support member 26 disposed on the ground surface 14 and which extends between and is connected to a T-shaped portion 28 integrally formed on the lowest end of each leg 16. Each portion 28 can also be a separate structural element adapted for removable securement into the lower end of each leg 16. To provide further support for the device 10, a pair of transverse support members 30 are removably insertable into each portion 28. The support members 30 also rest upon the ground surface 14 and project transverse to the support member 26. In addition, an upper vertical support member 32 extends between and is attached to the upper end of each leg 16 so as to provide further support and stability as well as maintaining the spaced disposition of the legs 16 from each other. The support member 32 is removably securable to the legs 16 by annular flanges 34 integrally formed at the upper end of each leg 16 and which project at a right angle to each respective leg 16. The flanges 34 can also be separate structural elements removably securable to the upper ends of the legs 16.

As shown in FIGS. 1–4 and 8, a platform means is mounted to the members 24 securable to the upper ends of the legs 20 and is used to balance the device 10 and provide structure which can be gripped by the user for steadying the device 10 as balls 12 are launched therefrom. The platform means includes a platform member 36 that is rectangular-shaped and includes a plurality of inter-fitting structural elements comprising elbows, straight pieces, and nipples. The platform 36 can also be a one-piece unit that is securable to the members 24 which are attached to the legs 20. To further secure the device 10 to the ground 14, at least one pair of flexible, stretchable, elongated straps 38 are secured to the bottom surface of the support member 32 and can be stretched and extended so that the straps 38 reach the ground 14 whereby a stake 40 attached to the distal end of each strap 38 can be inserted into the ground 14. When not in use, the straps 38 can be wrapped around the support member 32 and tied together to keep them in place while the device 10 is being transported to a different location for use or storage. In order to carry and store the balls 12, a bag 42 may be secured to one of the legs 16 and in which a plurality of balls 12 can be stored and used as desired.

As shown in FIGS. 1–8, the device 10 includes an elongated launching tube 44 of cylindrical cross section and which is secured to and rests upon the platform 36. The tube 44 is removably secureable to the platform 36 as shall be hereinafter further described. The tube 44 includes an ingress end 46 into which air is drawn, an opposite egress end 48 from which the balls 12 are expelled, and a bore 50 coequal in length with the tube 44. A plunger means is used to physically eject the balls 12 from the egress 48 and, as shown in FIGS. 1–9, the plunger means includes a rod and piston assembly comprising an elongated rod 52 which is slidable within the bore 50 in a linearly reciprocable manner. A substantial portion of the rod 50 is slidably receivable within the bore 50. The rod 52 has an inner end 54 which is completely enclosed within the tube 44 during all phases of linear movement of the rod 52 and an opposite outer end 56 which projects past the ingress 46 and terminates with a handle 58. The handle 58 is gripped by the user so that the user can manually slide the rod 52 in a linearly reciprocable manner within the bore 50 to launch the balls 12. The handle 58 may be a formed rubber member to facilitate firm and non-slip gripping by the user. In order to prevent the rod 52 from being pulled past the ingress 46 during the backward or intake motion or stroke of the rod 52, an end cap 60 is secured to the ingress 46. On the other hand, the rod 52 moves toward the egress 48 in the compression stroke. The cap 60 serves as a stop for checking and limiting the backward or intake motion of the rod 50. The cap 60 is removably securable to the ingress 46 and includes a centrally located aperture (not shown) through which the rod 52 is inserted for slidable reciprocable movement within the bore 50. Attached to the end 54 of the rod 52 is a piston 62. The piston 62 can be a circular metal or plastic disc and the diameter of the piston 62 substantially fills the bore 50. However, the outside diameter of the piston 62 is slightly smaller than the inside diameter of the tube 44, thus allowing the piston 62 to slide unimpeded within the bore 50. As the piston 62 moves from the intake stroke to the compression stroke, the piston 62 compresses a bolus of air within the bore 50 and the compression of air causes the balls 12 to be forcibly ejected from the tube 44. Depending on the length of the tube 44 and the strength of the particular user, it may take several cycles of intake and compression strokes to expel one ball 12 from the tube 44.

Figure 5:
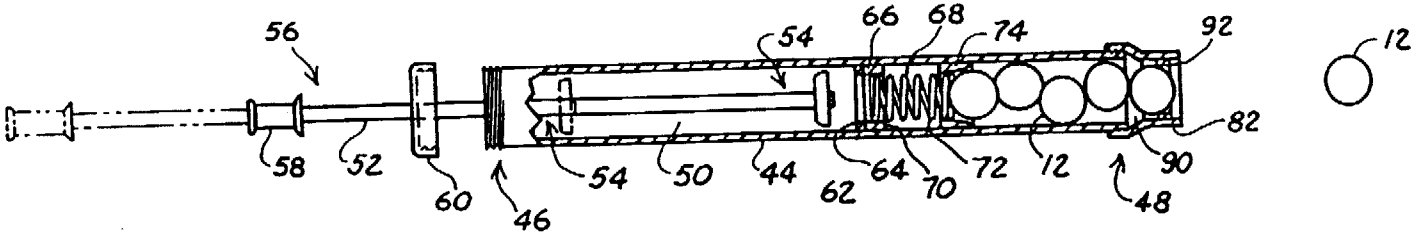
FIG. 5 is a sectioned side elevational view of the device first shown in FIG. 1, illustrating the disposition of internal structural components when a projectile is being ejected from the device.
Figure 7:
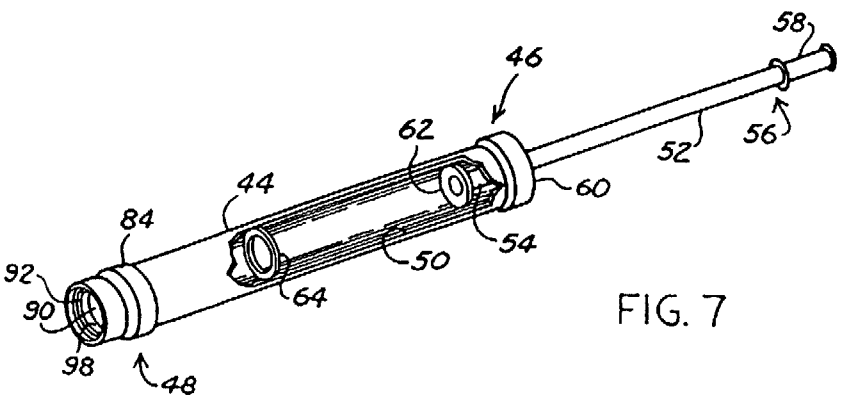
FIG. 7 is a perspective view of the launching tube shown partially in cut-away to illustrate internal structural components.
Figure 6:
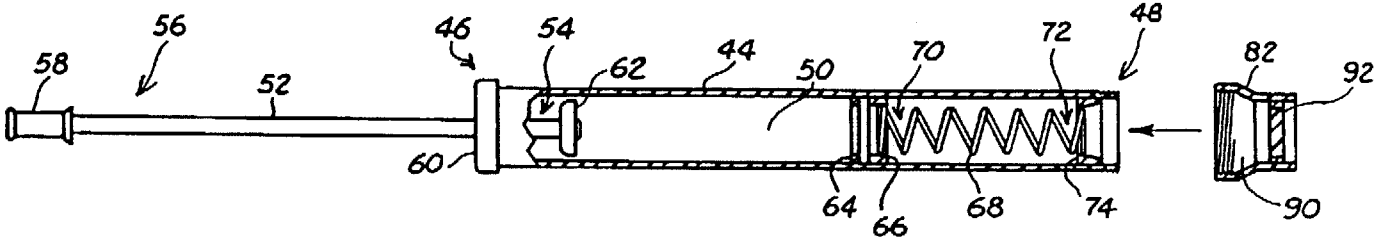
FIG. 6 is a sectioned side elevational view of the device first shown in FIG. 5, illustrating the manner of attachment of a shooting head to the launching tube.

As shown in FIGS. 5–7, structure is disposed within the bore 50 for halting the forward or compression stroke of the piston 62 after the piston 62 has traveled a certain distance therein. The means to halt the movement of the rod and piston assembly includes a piston abutment member disposed within the bore 50. The piston abutment member is secured to the inside surface of the tube 44 approximately two-thirds of the distance from the cap 60 and approximately one-third of the distance of the tube 44 from the egress 48. The piston abutment member provides a rigid, non-movable object which is struck by the piston 62 and which halts the slidable forward movement of the piston 62 within the bore 50. The present invention can use several different embodiments for the piston abutment member. For example, one embodiment of the piston abutment member can include a stud or bolt inserted through the tube 44 for extending transversely through the bore 50 and which is affixed to opposite sides of the tube 44. A metal block is secured to the middle of the stud and is centrally positioned within the bore 50. The metal block would provide a stop against which the piston 62 contacts in its forward movement and which would halt the further movement of the piston 62 within the bore 50. An alternative embodiment for the piston abutment member is shown in FIGS. 5–7, and includes a rigid annular member 64 composed of metal or plastic secured to the inside surface of the tube 44. The periphery of the piston 62 will strike the annular member 64 during the compression stroke and such contact will thereupon halt the further forward movement of the piston 62 toward the egress 48.

As shown in FIGS. 5 and 6, the device 10 uses a loading means to store and load the balls 12 within the tube 44 adjacent the egress 48. Specifically, the loading means includes an annular spring seating member 66, a compression spring 68 having a first end 70 secured to the seating member 66 and an opposite second end 72, and an annular loading member 74 secured to the end 72. The seating member 66 is secured to the inside surface of the tube 44 adjacent and immediately forward of the piston abutment member while the loading member 74 is attached to the end 72 but is not attached to the inside surface of the tube 44. Thus, as the user inserts balls 12 into the tube 44 from the egress 48, the first ball 12 is seated onto the loading member 74 and, as more balls 12 are loaded into the egress 48, the spring 68 compresses and loads while the loading member 74 slides backward toward the seating member 66. This position is shown in FIG. 5 while the unloaded state of the spring 68 is shown in FIG. 6. The spring 68 provides the balls 12 with additional momentum as the balls 12 are ejected from the egress 48.

Figure 9:
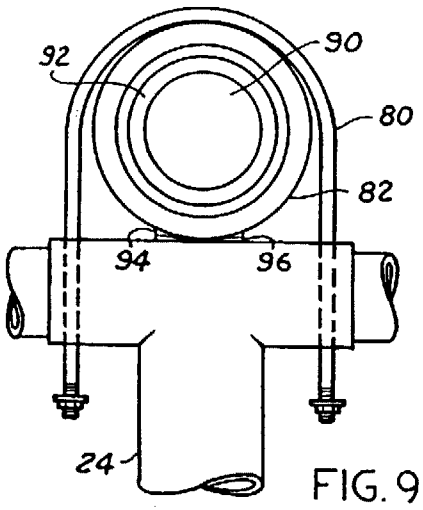
FIG. 9 is a fragmentary front elevational view of the device first shown in FIG. 1.
Figure 8:
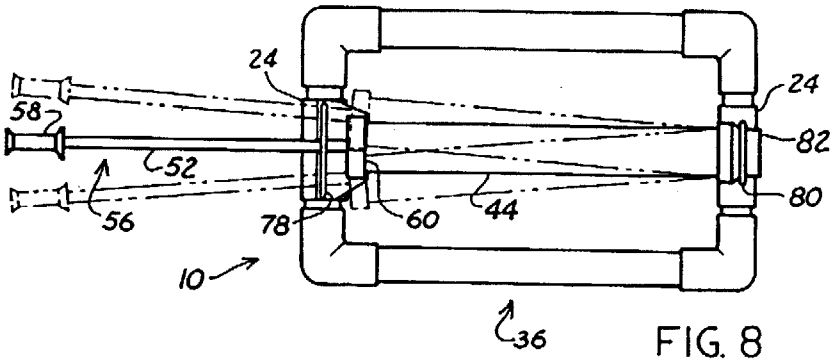
FIG. 8 is a top plan view of the device first shown in FIG. 1, illustrating the lateral adjustment of the launching tube.

As shown in FIGS. 1–4, 8 and 9, a means is provided for holding the tube 44 to the platform 36 so as to prevent the tube 44 from being lifted off the platform 36 during the launching and ejection of balls 12. The ingress 46 adjacent the cap 60 rests upon a flat receiving member 76 secured to the member 24 mounted to the upper end of the rear leg 20. A first inverted U-shaped member 78 is inserted through the receiving member 76 and into and through the member 24 so that the member 78 can be bolted and secured from the bottom of the member 24. The space formed by the member 78 is large enough to allow the rod 52 to pass therethrough but is smaller than the diameter of the cap 60 so that the cap 60 is not pulled through the member 78 during the intake stroke of the piston 62. A second inverted U-shaped member 80 is disposed on the member 24 mounted to the front leg 20 and holds the egress 48 down during the loading and launching of balls 12 therefrom. As shown in FIG. 9, the member 80 is inserted downwardly into and through the front end member 24 so that the member 80 is also bolted and secured from the bottom of the member 24. The members 78 and 80 can be large U-bolts or U-shaped plastic pieces and can be secured by various types of bolts, studs, or cotter pins. The member 78 provides a large clearance space for the rod 52 which permits the lateral positioning and repositioning of the rod 52 as shown in FIG. 8, while the member 80 can be tightened down on the member 24 to hold the egress 48 in place while still permitting slight lateral adjustment as shown in FIG. 8.

Figure 10:
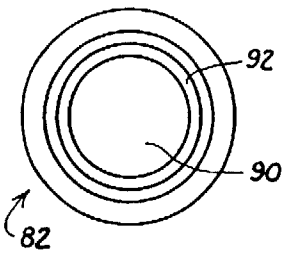
FIG. 10 is a front elevational view of a beginner's straight pitch shooting head.
Figure 11:
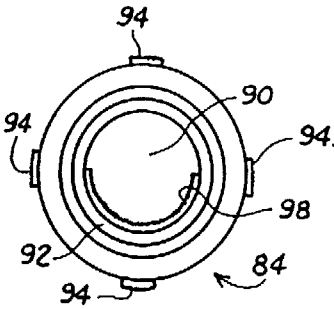
FIG. 11 is a front elevational view of a beginner's advanced variety shooting head disposed in the rising fast ball configuration.

In order to deflect the path of the balls 12 away from a flight path coincident with the axis of the tube 44, and also to provide the device 10 with a means to simulate a variety of baseball pitches, the device 10 includes a linear flight path deflection means. The linear flight path deflection means includes a plurality of shooting heads which are interchangeable and removably securable to the egress 48. FIG. 5 shows one representative shooting head secured to the egress 48. In FIG. 5 the spring 68 is loaded due to the loading and retaining of five balls 12 within the egress 48 while a sixth ball 12 is shown being ejected therefrom. FIG. 6 shows the tube 44 in cut-away with the same representative shooting head attached to the egress 48 with the rod 52 and piston 62 assembly drawn backward within the tube 44 toward the cap 60 for disposition to the loading or intake stroke. As will be explained more fully hereinafter, the shooting heads of the present invention comprise two beginner and two advanced versions or embodiments, but all the shooting heads have certain structural elements in common. Specifically, FIG. 10 shows the beginners straight pitch shooting head 82 and FIGS. 11–14 show the beginner variety shooting head 84 disposed in four different linear flight path trajectory deflecting configurations. FIG. 15 shows the advanced straight pitch shooting head 86 while FIGS. 16–19 show the advanced variety shooting head 88 disposed in four different linear flight path trajectory deflecting configurations.

Figure 12:
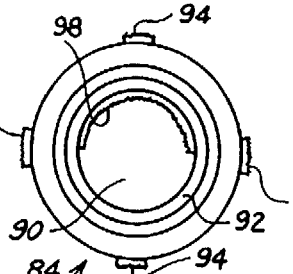
FIG. 12 is a front elevational view of the beginner's variety shooting head first shown in FIG. 11, illustrating the drop ball configuration.
Figure 13:
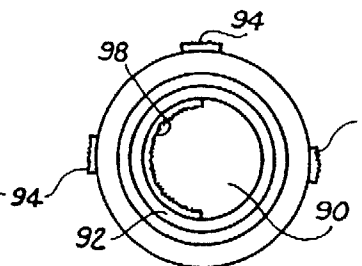
FIG. 13 is a front elevational view of the beginner's variety shooting head first shown in FIG. 11, illustrating the curve ball right configuration.
Figure 14:
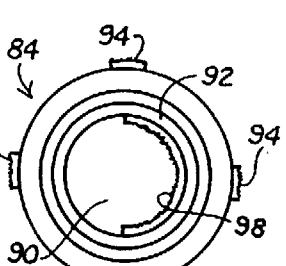
FIG. 14 is a front elevational view of the beginner's variety shooting head first shown in FIG. 11, illustrating the curve ball left configuration.
Figure 15:
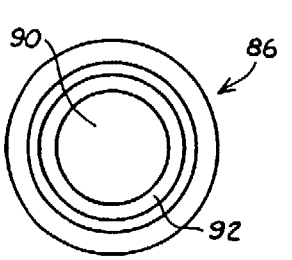
FIG. 15 is a front elevational view of an advanced straight pitch shooting head.
Figure 16:
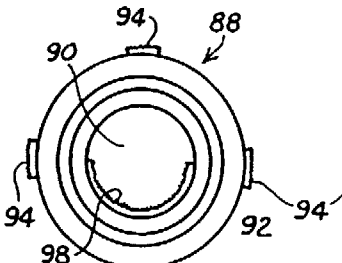
FIG. 16 is a front elevational view of an advanced variety shooting head disposed in the rising fast ball configuration.
Figure 17:
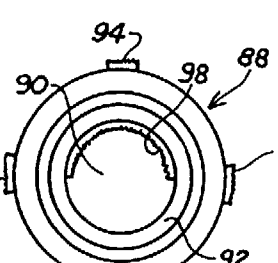
FIG. 17 is a front elevational view of the advanced variety shooting head disposed in the drop ball configuration.
Figure 18:
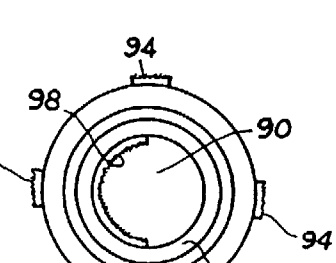
FIG. 18 is a front elevational view of the advanced variety shooting head disposed in the curve ball right configuration.
Figure 19:
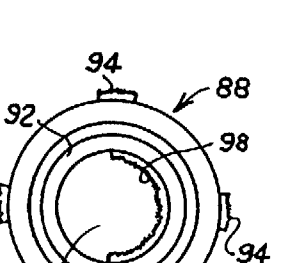
FIG. 19 is a front elevational view of the advanced variety shooting head disposed in the curve ball left configuration.

With reference to FIGS. 11–14 and 16–19, FIG. 11 illustrates the dispostion of the head 84 for producing a rising fast ball. FIG. 12 illustrates the disposition of the head 84 for producing a drop ball pitch. FIG. 13 illustrates the disposition of the head 84 for producing a curve ball right. FIG. 14 illustrates the disposition of the head 84 for producing a curve ball left. FIG. 16 illustrates the disposition of the head 88 for producing a rising fast ball. FIG. 17 illustrates the disposition of the head 88 for producing a drop ball. FIG. 18 illustrates the disposition of the head 88 for producing a curve ball right, and FIG. 19 illustrates the disposition of the head 88 for producing a curve ball left. The orientation of the batter or person catching the ejected balls 12 with reference to FIGS. 10–19 would be with the batter or person standing some distance in front of the heads of FIGS. 10–19.

Both the heads 82 and 84, and the heads 86 and 88, have a number of structural elements in common. Each head 82, 84, 86, and 88 includes an aperture 90 extending therethrough, and when the heads 82–88 are secured to the egress 48, the apertures 90 will be axially aligned with the axis of the bore 50. In addition, each head 82–88 includes an annular member secured to the inside surface of the heads 82–88; and, in the present invention, the annular member is a resistive rubber gasket 92 disposed circumjacent the aperture 90. The different heads 82–88 used by the present invention allow the user to expel balls 12 in a straight flight path coincident with the axis of the tube 44 and also in a variety of flight paths not coincident with the axis of the tube 44.

Figure 20:
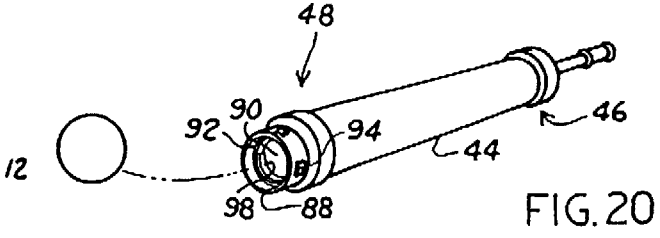
FIG. 20 is a perspective view of the advanced variety shooting head disposed in the rising fast ball configuration.
Figure 21:
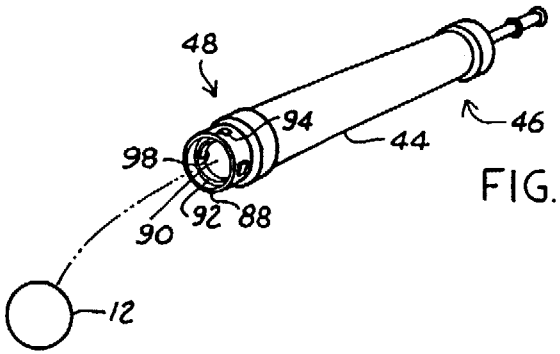
FIG. 21 is a perspective view of the advanced variety shooting head disposed in the drop ball configuration.
Figure 22:
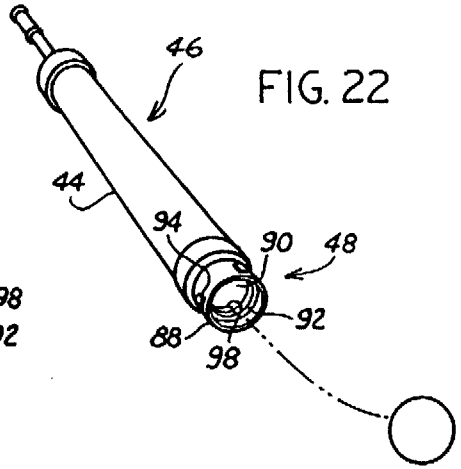
FIG. 22 is a perspective view of the advanced variety shooting head disposed in the curve ball right configuration.
Figure 23:
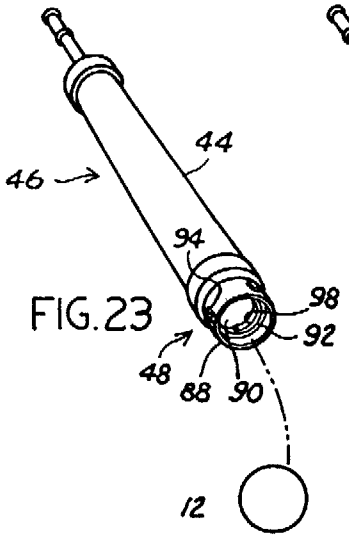
FIG. 23 is a perspective view of the advanced variety shooting head disposed in the curve ball left configuration.

For proper orientation with regard to the deflected flight paths shown in FIGS. 20–23, it is necessary to imagine an individual or practicing batter standing in front of the tube 44 with the balls 12 coming toward him. With reference to FIGS. 20–23, the description of the deflected flight paths would be for a right-handed batter. Thus, FIG. 23 shows the ball 12 coming out of the tube 44 with the head 88 in the position of FIG. 19 and curving to the left and slightly downward and into the batter (not shown). FIG. 22 shows the ball 12 coming out of the tube 44 of the head 88 in the position of FIG. 18 and curving to the right and downward and away from the batter. FIG. 20 shows the ball 12 coming out of the tube 44 of the head 88 disposed in the configuration of FIG. 16 with the ball 12 rising up toward the batter while FIG. 21 shows the ball 12 coming out of the tube 44 of the head 88 disposed in the configuration of FIG. 17 with the ball 12 dropping downward toward the batter's feet. If the batter was standing in front of the device 10 and batting left-handed, the deflected flight path of the balls 12 shown in FIGS. 20–23 would not be altered; but the descriptions of the movement of the ball 12 relative to the left-handed batter would be reversed for FIGS. 22 and 23. Also, the movement and path of the balls 12 using the head 84 disposed in the configurations shown in FIGS. 11–14 would be generally the same as shown in FIGS. 20–23 using the head 88.

Thus, for a left-handed batter standing in front of the tubes 44 shown in FIGS. 20–23, and, having either the head 84 or the head 88 secured thereto and disposed for the appropriate deflection, the curvature of the ball 12 shown in FIG. 23 would be downward and away from the batter while the curvature of the ball 12 shown in FIG. 22 would be downward and into the batter. The path of curvature of the ball 12 shown in FIG. 20 would simulate a rising fast ball for both a right-handed and a left-handed batter while the path of curvature of the ball 12 shown in FIG. 21 would simulate a dropping fast ball, or drop ball, for both a right-handed and a left-handed batter. The heads 82 and 86 shown in FIGS. 10 and 15 do not cause the balls 12 ejected therefrom to deflect away from the straight flight path coincident with the axis of the tube 44. The primary difference between the heads 82 and 86 is the speed with which the balls 12 are ejected from the tube 44; and the primary difference between the heads 84 and 88 is the greater speed and greater amount of deflection of the balls 12 when ejected from the head 88 as compared to the head 84.

The heads 84 and 88 shown in their flight deflecting dispositions in FIGS. 11–14 and 16–19 include attachment members or tabs 94 in the form of VELCRO strips or tabs secured to the outside surface of each head 84 and 88 at positions 90° from each other. These tabs 94 are securable to an attachment strip 96, also of VELCRO, secured to the upper surface of the front member 24, and this strip 96 is located within the arc of the member 80. Thus, the strip 96 can be mated to the tabs 94 of the heads 84 and 88 and this will hold the heads 84 and 88 in any of the configurations shown in FIGS. 11–14 and 16–19. For example, should the practicing batter decide to change the head 84 or 88 from the rising fast ball configuration of FIGS. 11 and 16 to the curve ball left configuration of FIGS. 14 and 19 (assuming a right-handed batter), the batter can simply rotate the head 84 or 88 counterclockwise 90° so that the tab 94 which holds the head 84 or 88 in the left curve ball disposition is mated to the strip 96 on the upper surface of the front member 24. The four tabs 94 and the strip 96 are all that are necessary to hold and maintain the heads 84 and 88 in the various flight deflection configurations shown in FIGS. 11–14 and 16–19.

Figure 24:
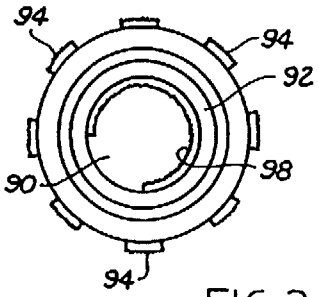
FIG. 24 is a front elevational view of the advanced variety shooting head first shown in FIG. 16.

As shown in FIGS. 11–14 and 16–23, the heads 84 and 88 include structural components which cause the balls 12, as they are forced through the aperture 90 of the heads 84 and 88, to deflect away from the linear flight path which is coincident with the axis of the tube 44. The projectile deflection means of the present invention is a semi-circular strip 98 glued or otherwise secured to the gasket 92 and which conforms to the curvature of the gasket 92 and the inside circumference of the respective heads 84 and 88. The strip 98 is a piece of VELCRO that provides a less resistive surface than the gasket 92 for the balls 12 as the balls 12 pass through the aperture 90 for ejection from the tube 44. Because the strip 98 provides less resistance than the gasket 92, the surface portion of the ball 12 contacting the strip 98 starts to spin as the opposite surface portion is momentarily restrained in its passage through the aperture 90 by the more resistive gasket 92. The difference in frictional resistance between the strip 98 and the gasket 92 imparts a spin to the ball 12 as it passes through the aperture 90 thereby causing the ball 12 to deflect or curve in the direction opposite the location of the strip 98. The gasket 92 and the strip 98 must be of certain dimensions to allow the balls 12 to pass through the aperture 90 with some resistance being applied to the balls 12, but the dimensions cannot be so constrictive that the balls 12 have extreme difficulty passing through the aperture 90 requiring, for example, twenty or thirty cycles of the rod 52 and piston 62 assembly before enough air pressure is built up in the tube 44 to eject the balls 12 therefrom. In the present invention, the dimensions for the gasket 92 for the heads 84 and 88 are as follows: outside diameter 1 13/16"; inside diameter 1 5/8"; width (thickness) 1/8"; and depth 7/16", as measured along the longitudinal axis of the bore 50. The analagous measurements for the dimensions of the heads 82 and 86 are the same except for the width (or thickness) which is 1/32" smaller (or 3/32" in thickness). Obviously, for smaller or larger shooting heads, the dimensions of the gasket 92 and the strip 98 will change. It should also be noted that while the projectile flight deflection means shown in FIGS. 11–14 and 16–23 is a semi-circular strip 98, the shape of the strip 98 can be shortened or lengthened to, for example, a strip covering one-quarter of the circumference of the gasket 92 or covering two-thirds of the circumference of the gasket 92. Indeed, the configuration of the strip 98 can be of any size including an annular strip circumjacent the entire inside diameter of the gasket 92. The placement of the tabs 94 can also vary; thus, the tabs 94 can be placed at 45° intervals, 30° intervals, 15° intervals, 5° intervals, etc. By varying the extent of the strip 98 relative to the gasket 92 and the number and placement of the tabs 94 on the heads 84 and 88, sinker, slider, and other types of pitches can be simulated. FIG. 24 illustrates one such alternative in that the tabs 94 are located at 45° intervals from each other and the strip 98 extends three-quarters of the length on the inside diameter of the gasket 92.

Although a certain preferred embodiment has been shown and described in detail, it should be understood that various changes and modifications may be made therein without departing from the scope of the appended claims.

I claim:

1. A ball launching device for launching projectiles in a deflected flight path, comprising:

a launching tube having an ingress end and an opposite egress end;

a plunger means disposed within the launching tube for selective slidable reciprocable movement therein in in order to eject projectiles from the egress end;

a plurality of shooting heads, each being selectively removably securable to the egress end of the launching tube, and each shooting head having an aperture for allowing passage of projectiles therethrough and an annular gasket inwardly disposed circumjacent the aperture;

projectile deflection means attached inward of the gasket for causing deflection of a projectile launched through the tube; and means to halt the movement of the plunger means disposed within the tube so that the amount of movement of the plunger means toward the egress end to eject the projectiles is limited.

2. The ball launching device of claim 1 wherein the plunger means includes a slidable, reciprocable, elongated rod having an inner end disposed within the launching tube and an outer end projecting past the ingress end of the launching tube.

3. The ball launching device of claim 1 wherein the plunger means includes a piston mounted to the inner end of the rod for concomitant movement therewith so that the movement of the piston compresses a bolus of air within the tube and causes the forcible ejection of one projectile from the launching tube.

4. The ball launching device of claim 1 wherein the means to halt the movement of the piston includes a piston abutment member disposed within and transverse to the launching tube adjacent the egress end so that the piston is limited in its movement toward the egress end during the ejection of a projectile.

5. The ball launching device of claim 1 wherein the projectile deflection means includes at least one semi-circular strip attached to the gasket and having an arcutae form for providing less resistance to the projectile than the gasket as the projectile is forced through the aperture thereby altering the rotation and velocity of the projectile and causing the deflection of the projectile away from the linear flight path coincident with the axis of the launching tube.

6. A ball launching device for ejecting projectiles therefrom, comprising:

a launching tube having an ingress end and an opposite egress end;

plunger means disposed within the launching tube for linear reciprocable movement therein so that a succession of projectiles can be ejected from the egress end by the movement of the plunger means;

means to halt the movement of the plunger means which is disposed within the launching tube adjacent the egress end;

a plurality of shooting heads, with each shooting head being selectively removably securable to the egress end of the launching tube;

each shooting head having an aperture extending therethrough and an annular member inwardly disposed circumjacent the aperture;

projectile deflection means attached to the annular member for causing deflection of the projectile as the projectile is launched through the tube and which conforms to the shape of the annular member; and the projectile deflection means providing a less resistive surface for the projectiles than the annular member so that the difference in frictional resistance imparts a spin to the projectiles as the projectiles pass through the aperture thereby causing the projectiles to deflect away from a linear flight path coincident with the tube axis as the projectiles are ejected from the egress end.

7. The ball launching device of claim 6 wherein the projectile deflection means can cover from at least one-quarter to three-quarters of the inner circumferential surface of the annular member.

8. A ball launching device for expelling projectiles therefrom and including a plurality of selectively interchangeable shooting heads for altering the flight path of the expelled projectiles, comprising:

a launching tube having an egress end and an opposite ingress end;

a rod and piston assembly disposed within the launching tube for slidable linear reciprocable movement therein so that the projectiles can be ejected from the egress end by the movement of the rod and piston assembly;

means to halt the movement of the rod and piston assembly disposed within the launching tube adjacent the egress end which limits movement of the rod and piston assembly toward the egress end during the ejection of the projectiles;

the selectively interchangeable shooting heads removably securable to the egress end of the launching tube, and each shooting head having an aperture for allowing passage of the projectiles therethrough;

an annular gasket inwardly disposed circumjacent the aperture of each shooting head;

projectile deflection means attached inward of the annular gasket for causing deflection of the projectiles as the projectiles are launched through the tube; and the projectile deflection means including at least one semicircular strip attached to the annular gasket for providing less frictional resistance than the annular gasket to the projectiles as the projectiles are forced through the aperture so that the rotation and velocity of the projectiles is altered, thus causing the projectiles to deflect away from a linear flight path coincident with the axis of the launching tube.

9. The ball launching device of claim 8 wherein the projectile deflection means can cover from at least one-quarter to three-quarters of the inner circumferential surface of the annular member.

* * * * *